US005409179A

United States Patent [19]

Leclerc et al.

[11] Patent Number: 5,409,179

[45] Date of Patent: Apr. 25, 1995

[54] COLLAPSIBLE REEL

[75] Inventors: M. Michel Leclerc, Ste-Croix; M. Gilles Houde, St-Antoine Tilly, both of Canada

[73] Assignee: Recherche et Developpement (JL) Inc., St-Antoine de Tilly, Canada

[21] Appl. No.: 87,050

[22] Filed: Jul. 7, 1993

[51] Int. Cl.[6] ..... B65H 75/14; B65H 75/22

[52] U.S. Cl. ..... 242/573; 242/574.4; 242/407.1

[58] Field of Search ..... 242/573, 573.1, 574, 242/574.1, 574.2, 574.4, 573.9, 576, 407.1; 191/12.2 R

[56] References Cited

U.S. PATENT DOCUMENTS

| | | | |
|---|---|---|---|
| 1,827,855 | 10/1931 | Parker | 242/574.4 |
| 1,862,598 | 6/1932 | Livermore | 242/574.4 |
| 2,264,992 | 12/1941 | McCarthy | 242/574 |
| 2,318,906 | 5/1943 | Troche et al. | 242/574.4 |
| 2,341,722 | 2/1944 | Kelleher et al. | 242/574.4 |
| 2,459,336 | 1/1949 | Powell | 242/574.4 |
| 2,529,185 | 11/1950 | Proctor | 242/573.9 |

FOREIGN PATENT DOCUMENTS 429110 7/1945 Canada .

*Primary Examiner*—John Q. Nguyen

[57] ABSTRACT

A collapsable reel using a sectional rim comprising articulated saddle shaped sections. One side of a section is fixed. A central bottom part can be tilted and the other side is fully inclinable. The lowering of the bottom added to the lowering of one side allows effortless removal of the coil. The reel comprises a central shaft, a set of eight radial arms fixed to the shaft and a second set of radial arms pivotally mounted on a slider bushing which is slidably related to the base of the fixed radial arms by a two arm linkage. A radially directed pin hinged at the intersection of the linkage is actuated by a sliding wedge located within the shaft and pulled by a handle, which pushes the pin outwards thereby folding the linkage. When the linkage is thus folded, it pulls in a slider linked to the articulated rim sections, thereby collapsing the sections to a smaller inside diameter than is possible when simply tilting a one piece saddle section. The light weight collapsing mechanism is spring loaded and needs only a push at the pin intersection for freeing the wound up coil from the reel.

7 Claims, 5 Drawing Sheets

COLLAPSIBLE REEL

BACKGROUND OF THE INVENTION

1. Field of the invention

This invention is related to the field of collapsible reels, and has for object the provision of new and improved collapsible reels allowing for effortless coil removal. A further object is to provide new and improved collapsible reels which may be easily collapsed and which may be securely latched in uncollapsed configuration.

2. Description of the Prior Art

A prior art patent search was conducted and a list of patents which appeared to us to be most pertinent to the invention follows.

U.S. Pat. No. 2,529,185 Nov. 21, 1946 Proctor shows a collapsible reel with four moveable spring loaded reeling arms locked into place by the wedging action of a locking nut which pushes the arms outwardly. When the arms are locked they grip one of the flanges which can be removed once the nut is unscrewed. The system requires the complete removal of a flange and unscrewing of the locking nut, operations that lengthen the task of removing the coil from the reel.

U.S. Pat. No. 2,459,336 Oct. 22, 1946 Powell illustrates a collapsible reel where the collapsible spokes are made up of two parts, one of them rigid and the other hinged at the bottom and able to rotate and thus freeing the coil of wire. The locking mechanism uses a hub comprising internal latches and links attached to the collapsible arms to prevent the arms from moving while in uncollapsed position. The holding capacity is limited by the semi-circular shape of the bottom of the coil retaining assembly. Moreover the relative complexity of the locking mechanism makes it prone to malfunction in intense field use.

CN 429110 Mar. 15, 1943 Troche illustrates a system in which sectional rims collapse, thus allowing the coil to be removed. A segmented rim comprises an articulated one piece saddle shaped coil support, a mechanism using links and a longitudinally moveable spider allows the coil support to move from an uncollapsed to a collapsed position. The displacement is controled by the position of the spider along the shaft. The hub of the spider comprises an extension along which run two helical grooves which fingers protruding from a locking handle thread in. By rotating the handle, the spider is moved along the shaft, pushing the links and thus lowering the sections of the rim. Though the position of the saddle changes, the angle swept is insufficient for the coil to pass easily over the edge upon removal of the coil. A hammer is often needed, thus lengthening the process and requiring greater effort from the operator.

U.S. Pat. No. 2,264,992 Dec. 2, 1941 McCarthy describes a collapsible reel for rope and similar material. The reel is composed mainly of two sets of two pairs of narrow flat bars; one set is fixed and one set is collapsible. The rope wraps around four longitudinal bars mounted outwardly around a central shaft. At the fixed end, the longitudinal bars are hinged on the radial bars fixed at the rear of the central shaft. At the collapsible end, the collapsible bars are hinged at a 90° angle on the longitudinal bars. The collapsible bars have a lever extention hinged to attachment brackets sliding on the shaft. A central spring acts on a bushing pushing the brackets, thus strenghtening the reel in winding position. The skeleton structure is not strong enough to withstand the strain of use with heavy-duty electrical wire because the only blocking mechanism is a spring which can be compressed by the leverage action of a person manually tilting the collapsible bars. Under pressure from heavy duty electrical cable, the coil could be released without warning.

While study of the prior art shows several inventions proposing solutions to the problem of providing an efficient collapsible reel, none has a combination of means or capabilities equalling those of my invention.

SUMMARY OF THE INVENTION

The main objective of the invention is to provide effortless coil removal by means of articulated saddle shaped sections forming a rim of a collapsable reel, the sections to be provided with one rigid side, normally oriented on the side of the drive, a bottom than can be lowered 15° respective to its original position relative to the rigid side and a collapsible side that can be lowered to an angle of 160° from an original angle of 95°. The lowering of the bottom added to the reduction in diameter make for the effortless removal of the coil.

A second objective is to provide simple and efficient spring loaded means to positively lock the reel while the reel is in uncollapsed position.

A general objective is to provide a folding mechanism located within the space occupied by the saddle sections and thus providing a compact and lightweight collapsible reel for coiling electrical wires, or similar material and having in combination:

a central support shaft comprising a rear section, a middle section and a front section;

a rigid side mounted cicumferentially on the shaft, for side support of the coil, comprising a set of first radial arms fixed to the rear of the shaft, these radial arms comprising a base, a middle portion and a tip;

a coil retaining central portion, comprising a number of plaques pivotally mounted on each fixed arm;

a set of second radial arms each arm being pivoted intermediately to the plaque, between erected and collapsed positions, in erected position the first fixed and second pivoting arms being sensibly parallel to each other and perpendicular to the shaft and the plaque being parallel to the shaft, in collapsed position the plaque being inclined relative to the shaft and the second pivoting arm being further inclined almost parallel to the shaft, the second radial arm comprising an inner end oriented towards the shaft, an intermediate portion and an outer end tip;

a slider axially mounted on the front end of the shaft and pivotally attached to the inner end of each of the second arms the slider being able to move from a closed position corresponding to the erected arm position to an open position with arms in collapsed position;

means for blocking the second arms in erected position, thus locking the slider in closed position.

The above mentioned and other advantages of the invention will be better understood in reference to the following description and drawings in which.

Figure 1:
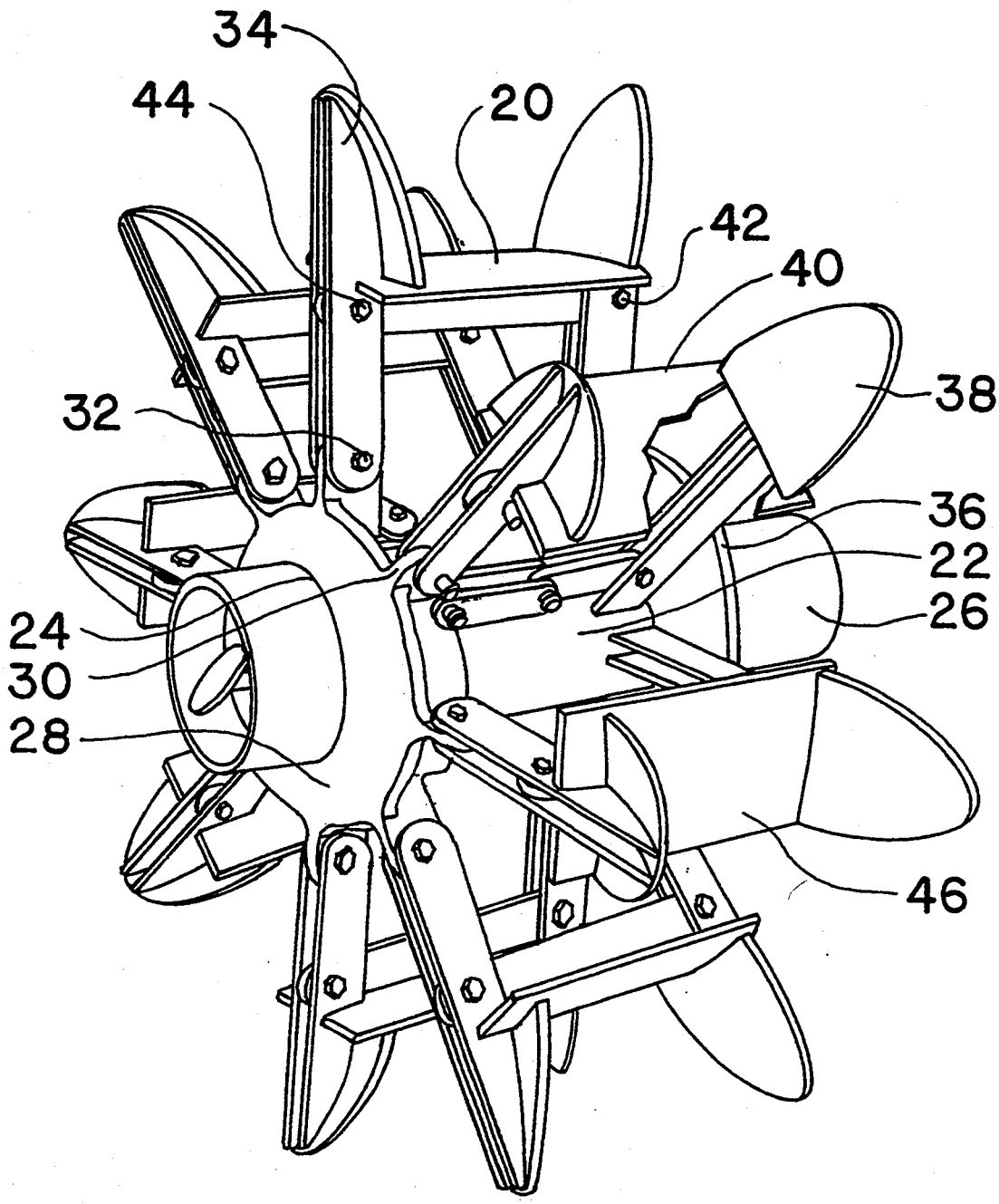
FIG. 1 is a perspective of the reel in the uncollapsed position.
Figure 2:
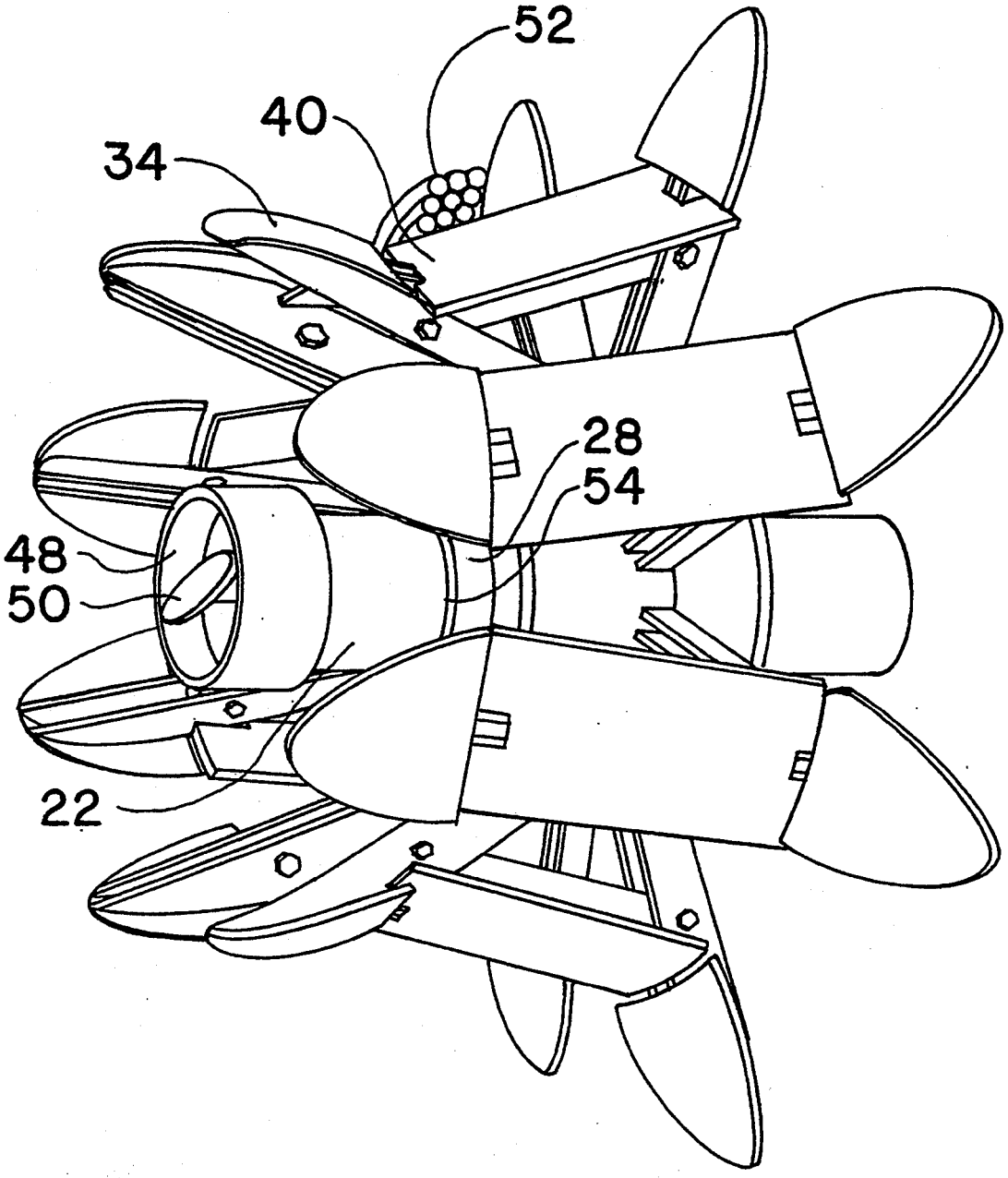
FIG. 2 is a perspective of the reel in the collapsed position.
Figure 4:
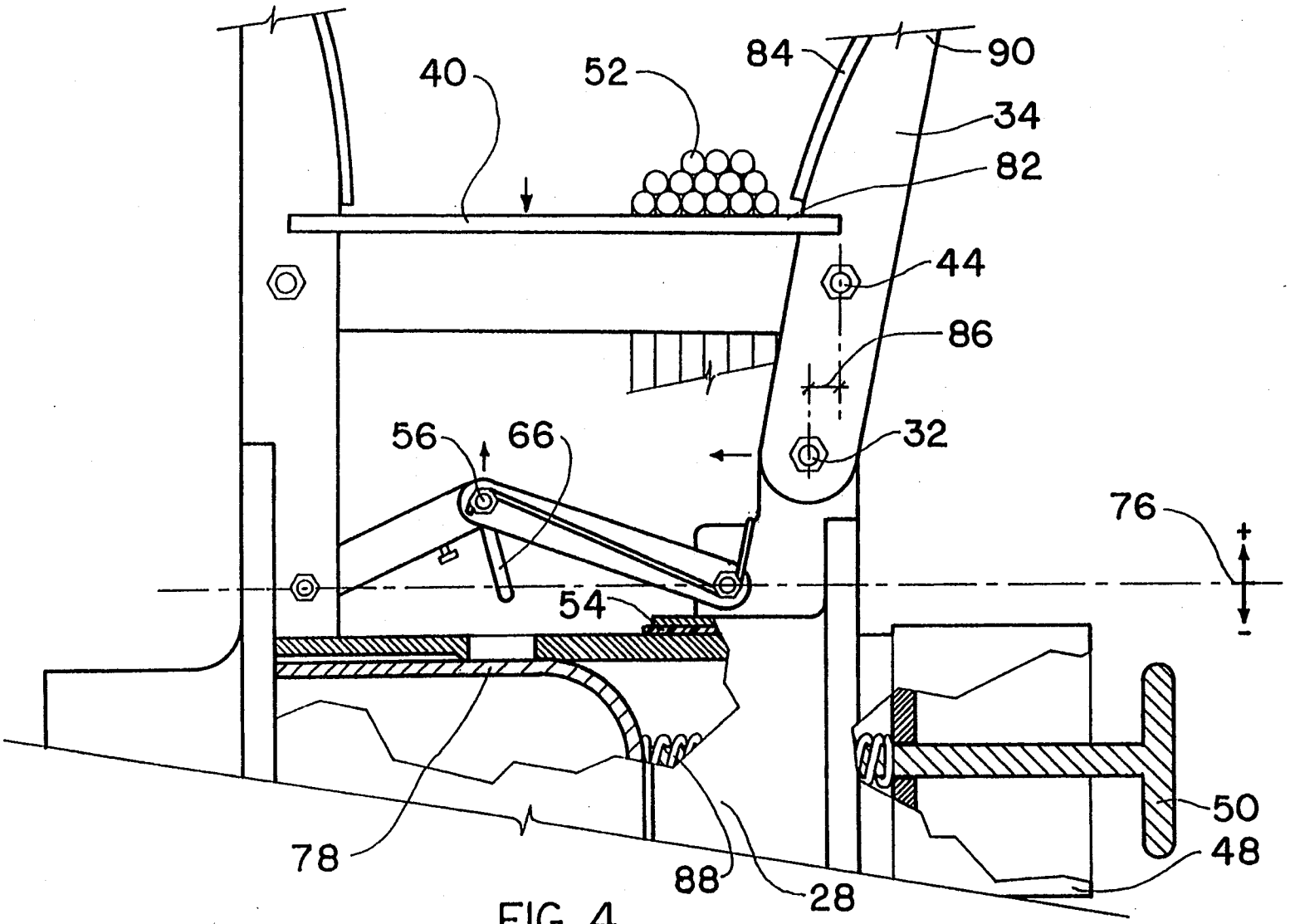
FIG. 4 is the view of FIG. 3 with the mechanism midway towards the collapsed position.
Figure 5:
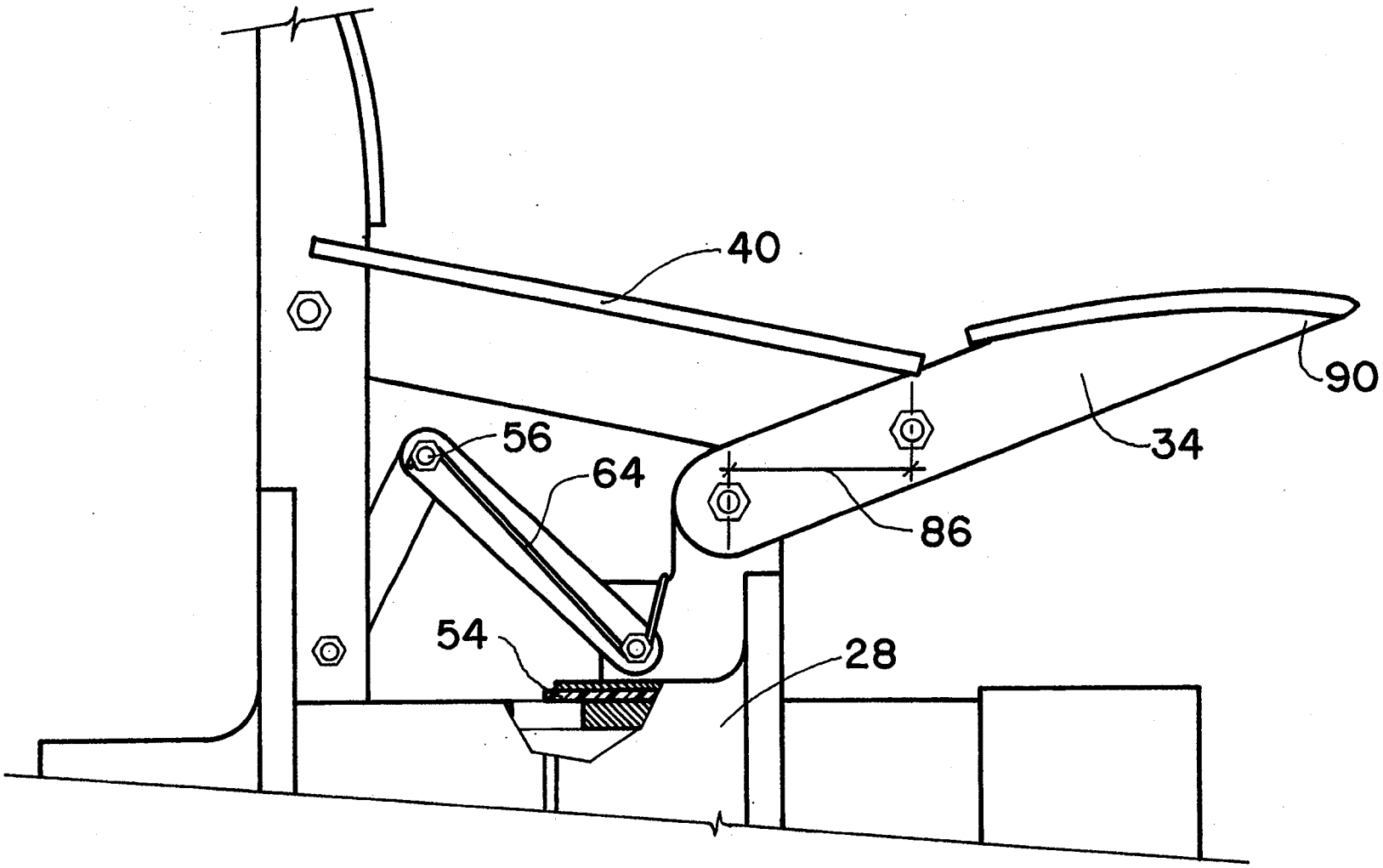
FIG. 5 is the view of FIG. 3 with the actuating mechanism in collapsed position.

The prefered embodiment of the invention is illustrated in FIG. 1. FIG. 1 where the components can be identified by like numbers on all figures, where one can see a reel 20 comprising a central shaft 22, with an open front end 24 of a generally tubular shape and a rear end 26 which is adapted as a coupler, on the outside of the open front end can slide a slider bushing 28 located at the open front end 24. Eight radial attachment extensions 30 are distributed circumferentially around the slider bushing 28 at equal distance. Eight pivoting radial arms 34 are each attached on a corresponding radial attachment extension 30 of slider bushing 28 by means of a first pivot 32 in a spider shaped arrangement. A strengthening disk 36 adapted to receive eight fixed radial arms 38 facing the foldable pivoting radial arms 34, is welded at the rear end 26 of the central shaft 22. Each fixed radial arm 38 is linked to the pivoting arm facing it by a tiltable plaque 40 by means of a hinge slack bolt 42 placed vertically relative to strengthening disk 36 and second pivot 44 mobile circumferentially relative to the slack bolt 42. The eight tiltable plaques 40 form the bottom of reel 20. The open front end 24 of the central shaft 22 is capped by a hollow cylinder 48 (FIG. 2), fixed to the central shaft, and inside which one can see a handle 50 used to pull the locking mechanism, later described in FIG. 3, of the reel. The pivoting radial arms 34 move towards the central shaft while the tiltable plaques 40 tilt also towards the centre, allowing for easy removal of the coil 52. A nylon bushing 54 fits inside the slider bushing 28 to facilitate movement along the central shaft. The mechanism actioning the collapsing of the reel comprises a knee type two member link 56 (FIG. 3) possessing a fixed pivot 58, a central pivot 60 mobile around the fixed pivot 58, a mobile pivot 62 moving parallel to the central shaft, a leaf spring 64, a radial pin 66 attached to central pivot 60 and radially penetrating the central shaft 22 by way of 8 hole 68, a first member 70 linking fixed pivot 58 and central pivot 60 and a second member 70 linking central pivot 60 to mobile pivot 62. The first member 70 possesses an adjustment screw 74 used to position the central pivot 60 under the axis 76 passing by fixed pivot 58 and mobile pivot 62. The knee is then in a "negative" position, thereby blocking the collapsing mechanism. The handle 50 is attached to a rod 80 and to a half-moon 78 which has a wedge-like form. In that manner, when the operator pulls on handle 50 (FIG. 4), the half-moon 78 pushes radial pin 66 of the knee 56 and positions the knee in a "positive" position, i.e. over the axis 76, thereby slightly displacing first pivot 32 of pivoting radial arm 34 towards the interior of the reel, thus lowering slightly the tiltable plaque 40. The knee 56 thus unlocked, the tension and the weight of the coil 52 on the tiltable plaque 40, more specifically on side 82 corresponding to slider bushing 28 and specifically on the internal face 84 of the pivoting radial arm 34, have a tendency to move slider bushing 28 towards the interior while pivoting radial arm 34 is folded at the same time as tiltable plaque 40 is tilted. The ease of the displacement motion of slider bushing depends on the low friction of the nylon bushing 54 and also on the relative position of first pivot 32 and second pivot 44, which forms a moment of a magnitude augmenting as first pivot 32 moves towards the interior. This is because the horizontal distance 86 respective to the vertical at first pivot 32 and second pivot 44, grows longer with the displacement of slider bushing 28 towards the interior of the reel (FIG. 5). The coil having at the start an internal diameter of 20 inches is supported by a set of pivoting radial arms 34 which after folding have a diameter of 17 inches. The operator can then remove the coil from the reel very easily.

A spring 88 (FIG. 4) which may be tension or compression, repositions the handle 50 inside the hollow cylinder 48. Finally bypushing the extremities 90 of the of pivoting radial arms 34, the reel returns to its uncollapsed position. Theleafspring 64 insures the "negative" position of knee 56 respective to axis 76 (FIG. 3) and also the locking in uncollapsed position of the reel. The slider bushing 28 may have grooves adapted to receive male parts located on the cylinder 48 which eliminates any possibility of circumferential sliding of the slider bushing 28 relative to the central shaft 22 when a cable is being wound up.

OTHER EMBODIMENTS

It will be understood that while I have herein illustrated and described the features of my invention as related to a preferred embodiment thereof, several changes, modifications and substitutions of equivalents might be resorted to therein without departing from the spirit and the scope of the invention involved. For example: blocking means may comprise toggle lever systems comprising several linkage members disposed along a horizontal axis sensibly parallel to the shaft one member pivoted at the base of the fixed arm, a second member pivoted at the inner end of the pivoting arm and a junction between the linkage members located near the shaft and below the horizontal axis, the blocking means further comprising means for unlocking the toggle lever.

The means for unlocking may be a number of radially directed pins caused to outwardly displace the junction between the linkage members to provoque flexion; the pushing means might come from the interior of a hollow shaft.

The central shaft is generally tubular but may be of another cross section and comprise holes pierced in wall of the middle of the shaft to accomodate the pins and further comprise wedge means located inside the tubular shaft in any number from one to eight and wedgedly displaced by an exterior front handle or otherwise to outwardly displace the pins when the handle is pulled. The wedge means may comprise a half moon or U-shaped section and further comprise spring means located inside the rear section of the shaft for pulling back the wedge when not pulled by the handle.

A spring shaped like a wide angle "V" or other lever spring may have a leg acting downwardly onto the junction of the knee joint and the other leg acting onto the attachment point of the slider, the central portion being turned around the slider pin.

Figure 3:
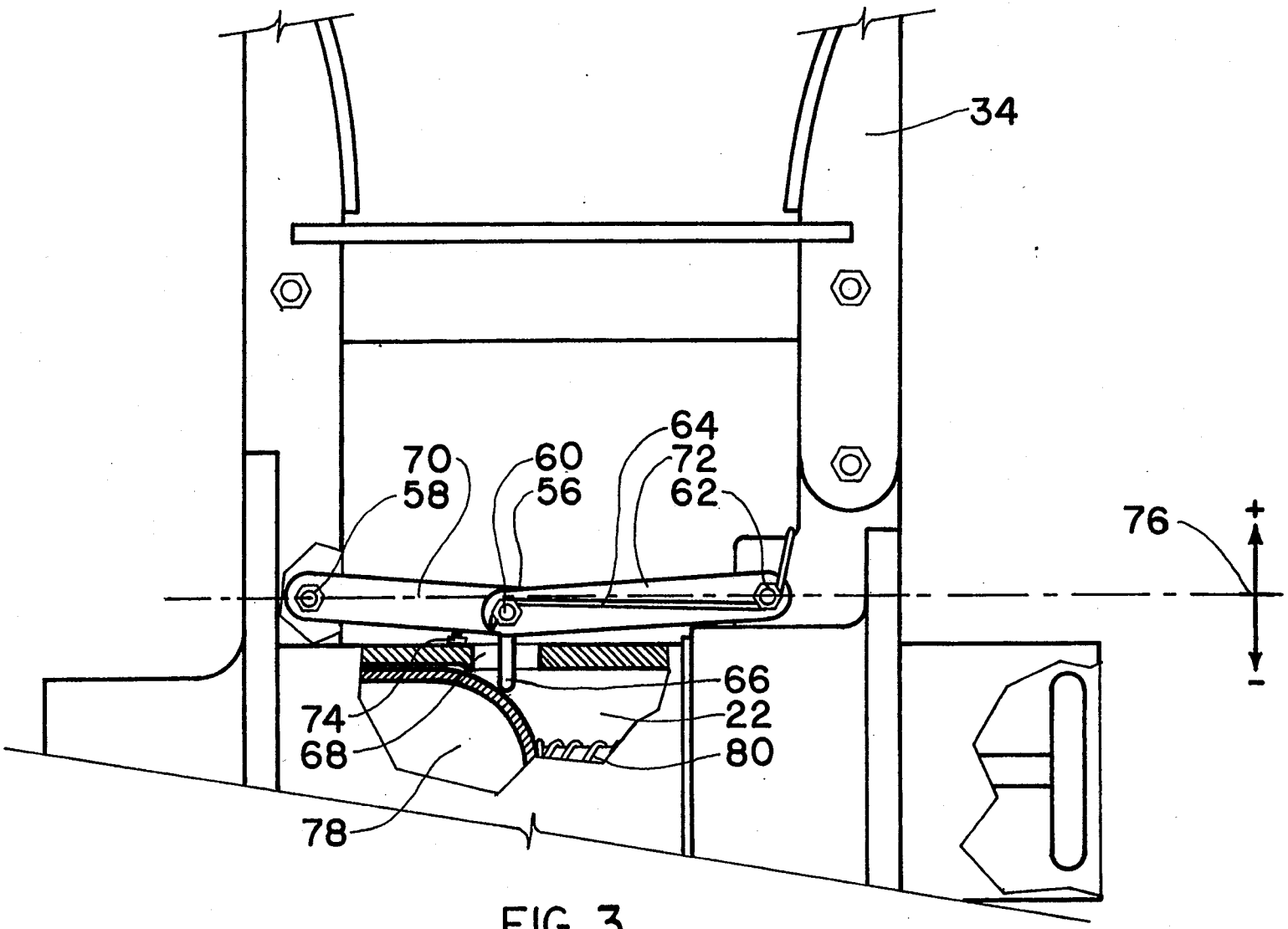
FIG. 3 is a side view of the actuating mechanism in the uncollapsed position.

The adjusting means may be a stop comprising a screw 74. FIG. 3, which screws in one of the linkage members and whose head is oriented towards and resting against the central shaft, thereby controling the stopping point between the junction and the horizontal axis. The open area 68 may be wide enough to allow for passage of pin 66 at different angles of orientation, pin 66 being preferably attached to link element 70.

Means for adapting to a power shaft include bayonnet coupling, adapted with two keyways formed in the hollow wall of the rear section.

The retaining tips of the arms may be shovel shaped plates comprising a backwardly curling tip; the plaques may be curved downwardly at the centre and each plaque secured under the apex of the downward curve by a bar shaped support of a length exceeding the length of the plaques by a sufficient amount, such as one inch, to adapt a pivot between the plaque and the arms.

Two externally opposed longitudinal guides may serve as coupling for driving the slider in rotation still allowing for longitudinal movement of the slider along the shaft.

Any of the pivots may comprise a slack bolt going through a hole piercing adjoining members and comprise soldered nuts for preventing unscrewing.

As a consequence, it is not my intention that I be limited to the specific form my invention herein illustrated and described except as may appear in the following appended claims:

LIST OF PARTS:

reel
central support shaft
open front end
rear end section
slider bushing
radial attachment extension
first pivot
pivoting second radial arm
strengthening disk
fixed first radial arms
tiltable plaque
slack bolt
second pivot
hollow cylinder
handle
coil
nylon bushing
knee
fixed point
central pivot
mobile pivot
leaf spring
radial pin
hole
first linkage member
second linkage member
adjustment screw
axis
half-moon
rod
side
internal face
horizontal distance
spring
extremities

I claim:

1. A collapsible reel for coiling a coil of electrical wires having in combination:

a central cylindrical support shaft comprising a rear end section, a middle section, and a front section;

a rigid side mounted circumferentially on said rear end section for side support of said coil, said rigid side comprising a set of fixed elongated first radial arms fixed to said rear end section, each first radial arm comprising a base fixed to said rear end section and having a first pivot point, a middle portion having a second pivot point, and a tip;

a coil retaining central portion comprising a number of axially elongated plaques equal to the number of said first arms, each plaque pivotally mounted at one end to said second pivot point of a corresponding fixed arm and circumferentially of said middle section and radially spaced therefrom;

a set of elongated second radial arms, each second arm comprising an inner end oriented towards said shaft, an intermediate portion, and an outer end tip, each second arm installed axially in line with a corresponding plaque and a corresponding fixed first radial arm and being pivoted at said intermediate portion to the other end of a corresponding plaque and movable between an erected position and a collapsed position, in the erected position said fixed radial arms and said movable second arms extending substantially parallel to each other and perpendicular to the axis of said central shaft and said plaques extending substantially parallel to said axis, in the collapsed position said plaques and said second radial arms being inclined to said axis with said second arms almost parallel to said axis;

a slider bushing mounted on said front section of said central shaft, each inner end of each second arm being pivotally attached to said slider bushing, said slider bushing being able to move axially between a closed position corresponding to said erected position and an open position corresponding to said collapsed position;

a toggle lever system for locking the slider bushing in the closed position thus locking said second arms in the erected position, said toggle lever system comprising first and second elongated linkage members, said first linkage member having a fixed pivot point at a first end and a central pivot point at a second end, said fixed pivot point being pivotally mounted to the first pivot point of one fixed radial arm and said central pivot point being pivotally attached to one end of said second linkage member, said second linkage member having a mobile pivot point at the other end being pivotally attached to said slider bushing, the junction between said linkage members at said central pivot point being located closer to said axis when locked by said toggle lever system than a line parallel to said axis and connecting the fixed pivot point and the mobile pivot point when the second arms are in the erected position and being farther from said axis than said line when in said collapsed position, said mobile pivot point moving along said line;

said toggle lever system further comprising means for unlocking the slider bushing from the closed position.

2. A collapsible reel as in claim 1 wherein said means for unlocking comprise a radially extending pin for radially outwardly displacing the junction between said linkage members, said pin adapted to be radially pushed outwardly by means for pushing to toggle the linkage members to move the slider bushing to the open position.

3. A collapsible reel as in claim 2 wherein said pin is attached to either of said linkage members at said junction and extends radially inwardly toward said shaft.

4. A collapsible reel as in claim 3 wherein said central shaft is generally tubular and comprises a hole in said middle section to accommodate said pin and said pushing means comprise wedge means located inside said tubular shaft and movable in a forward direction by a handle for engaging and outwardly moving said pin when said handle is pulled forwardly.

5. A collapsible reel as in claim 4 wherein said wedge means comprise a half-moon shaped section and further comprising spring means located inside said rear end section for biasing said wedge means in a backward direction.

6. A collapsible reel as in claim 1 wherein said toggle lever system further comprises a spring shaped like a wide angle "V" having a first leg acting onto said junction and a second leg acting onto an attachment point of said slider bushing to bias said junction towards said shaft and a means for adjusting the position of said junction when the slider bushing is in the closed position.

7. A collapsible reel as in claim 6 wherein said means for adjusting is a stop comprising a screw on one of said linkage members having a screw head oriented towards and engaging said shaft when said slider bushing is in the closed position, thereby controlling the stopping point of said junction relative to the shaft.

* * * * *